US006991186B2

(12) United States Patent
Völkel et al.

(10) Patent No.: US 6,991,186 B2
(45) Date of Patent: Jan. 31, 2006

(54) SPRAY BOOM FOR A HYDRAULIC DESCALING FACILITY

(75) Inventors: Werner Völkel, Erndtebrueck (DE); Helmut Stötzel, Hilchenbach (DE); Bernd Niklas, Wenden (DE); Peter Kniesa, Hilchenbach (DE); Achim Klein, Kreuztal-Kredenbach (DE)

(73) Assignee: SMS Demag AG, Düsseldorf (DE)

( * ) Notice: Subject to any disclaimer, the term of this patent is extended or adjusted under 35 U.S.C. 154(b) by 91 days.

(21) Appl. No.: 10/489,901

(22) PCT Filed: Sep. 3, 2002

(86) PCT No.: PCT/EP02/09795

§ 371 (c)(1),
(2), (4) Date: Mar. 17, 2004

(87) PCT Pub. No.: WO03/024636

PCT Pub. Date: Mar. 27, 2003

(65) Prior Publication Data

US 2004/0251324 A1 Dec. 16, 2004

(30) Foreign Application Priority Data

Sep. 19, 2001 (DE) ..... 101 46 113

(51) Int. Cl.
*F23D 14/48* (2006.01)

(52) U.S. Cl. ..... 239/548; 239/548; 239/550; 239/551

(58) Field of Classification Search ..... 239/570, 239/572, 569, 562, 548, 565
See application file for complete search history.

(56) References Cited

U.S. PATENT DOCUMENTS

| | | | | | |
|---|---|---|---|---|---|
| 3,782,634 | A | * | 1/1974 | Herman | 239/156 |
| 5,441,203 | A | * | 8/1995 | Swan et al. | 239/574 |
| 5,673,858 | A | * | 10/1997 | Asakawa et al. | 239/553.3 |
| 5,996,200 | A | | 12/1999 | Rosenthal et al. | |
| 6,193,166 | B1 | * | 2/2001 | Miller et al. | 239/76 |

FOREIGN PATENT DOCUMENTS

| | | | |
|---|---|---|---|
| DE | 3733131 | A1 * | 4/1989 |
| DE | 4007727 | | 9/1990 |
| DE | 4007727 | A1 * | 9/1990 |
| DE | 9805377 | | 8/1999 |
| DE | 19805377 | A1 * | 8/1999 |

OTHER PUBLICATIONS

Patent Abstract of Japan, JP–04 046625 May, 1992.

* cited by examiner

*Primary Examiner*—David A. Scherbel
*Assistant Examiner*—James S. Hogan
(74) *Attorney, Agent, or Firm*—Sidley Austin Brown & Wood, LLP

(57) ABSTRACT

In order to provide a spray boom with a plurality of spray nozzles for a hydraulic descaling facility with which a high temperature constancy from beginning to the end of the rolling stock is insured and a too rapid cooling of the surface is prevented, it is proposed, in accordance with the invention, to assign a check valve to each spray nozzle.

8 Claims, 2 Drawing Sheets

SPRAY BOOM FOR A HYDRAULIC DESCALING FACILITY

Figure 1:
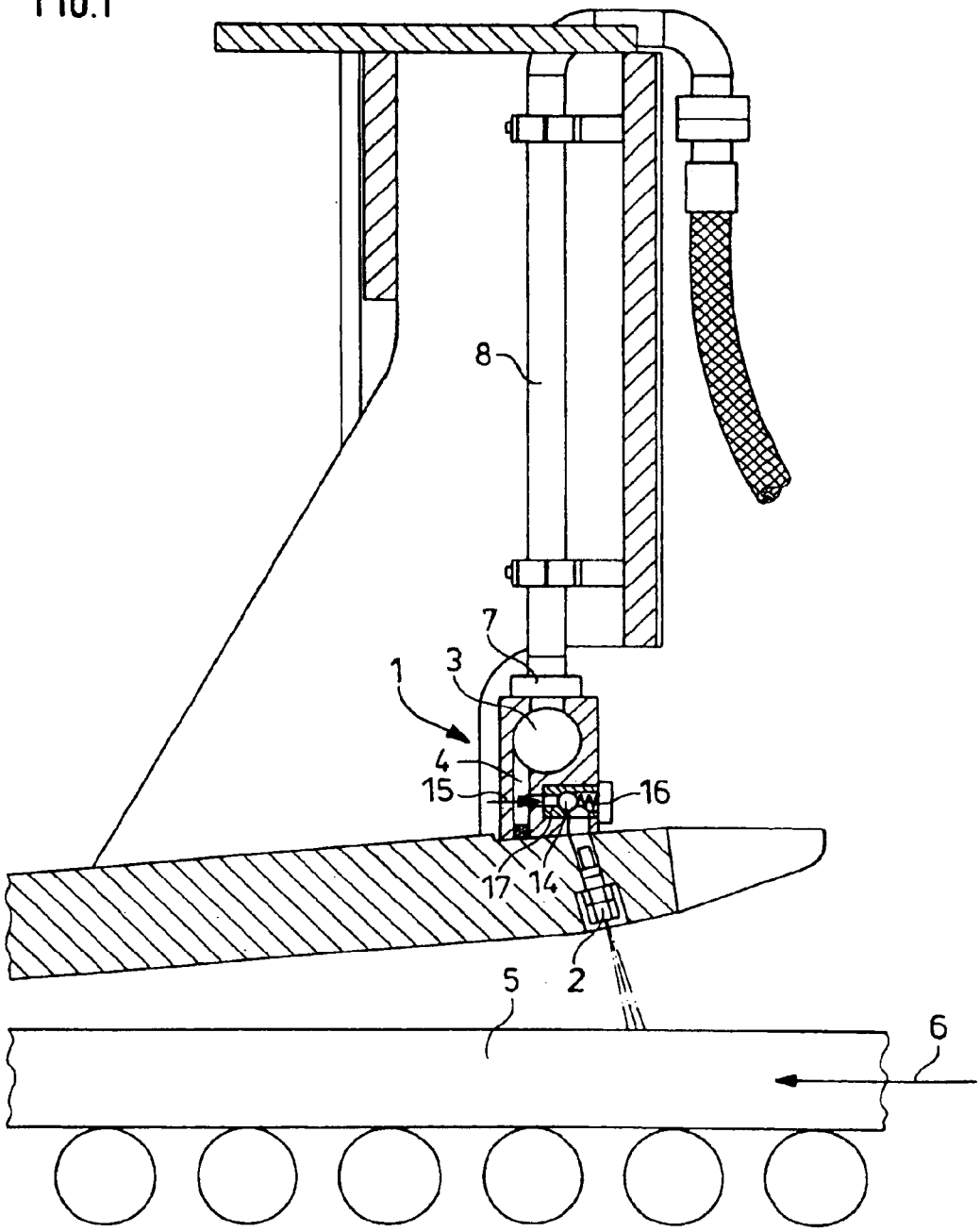

The present invention relates to a spray boom of a hydraulic descaling facility with a plurality of spray nozzles arranged on its surface.

Scale, which is produced in a furnace during rolling or casting, leads to a high wear of tools or rolls and prevents an early detection of casting errors, which adversely affects the quality of the end product.

The scale can be removed chemically, electrochemically or mechanically. An effective mechanical descaling is possible with hydraulic descaling facilities, which remove primary or secondary scale with jets of pressurized water.

The pressurized water jet, which strikes the glowing scaled steel surface, removes the scale. Among the process-relevant parameters, a cooling-down effect and fracture effect can be named and the influence of which essentially depends on the flow rate per unit of time, the water pressure in front of the nozzle and the distance between the nozzle and the removable material. The known hydraulic descaling facilities includes spray booms with a plurality of spray nozzle arranged on its surface.

DE 3733131 A1 discloses a spray boom in which separate spray valves actuate separate spray nozzles. With such spray booms, the energy and water consumption can be adapted to the width of the descalable rolling stock.

DE 198 05 377 A1 discloses, in addition, a spray boom with a plurality of groups of spray nozzles arranged in a row, with the spray nozzles being separately actuated by actuation of a common servo component. The servo component is arbitrary axially displaceable, rotated, or is screwed in or out of a distribution pipe for the spray water.

In addition to an exact adaptation to the width, with an ever increasing range of to-be-rolled special steels, a temperature constancy from the strip beginning to the strip end plays a crucial role. Finally, there is a need in rolling processes with which the simultaneous spraying of water is not necessary for each passage of the rolling stock through a stand because otherwise the surface will cooled down too rapidly.

Accordingly, on object of the invention is to provide a spray boom which would insure a high temperature constancy from the beginning to the end of the rolling stock and which would prevent a too rapid cooling of its surface.

The solution of this problem is based on an idea of an exact turning on and off of the spraying water, in particular, at the strip beginning and the strip end. In addition, exit of the residual water from the spray nozzles should also be prevented.

Generally, this object is achieved by assigning a check value to each spray nozzle of a spray boom of the type discussed above.

When the spray boom has at least one distribution pipe for feeding water to spray nozzles and feed channels which branch from the distribution pipe to the spray nozzles, the undesirable exit of the residual water is effectively prevented by arranging the check valves in the feed channels, preferably, immediately before each spray nozzle.

As soon as a hydraulic control of the descaling facility turns off water, the check valves become effective so that in a blink of an eye, no water reaches the rolling stock.

In order to provide for adaptation to the width of the rolling stock, according to a preferred embodiment of the invention, the spray nozzles are actuated separately in per se known manner.

Each check valve has, advantageously, a closing spring acting in a direction opposite to the flow direction, so that the check valve opens against a biasing force of the closing spring. The biasing force of the closing spring is adapted to the pressure of water in the spray boom. As soon as the water flow stops, the water pressure is reduced, and the closing springs displace the shut-off elements of the check valves in their closed position.

The monitoring and/or the exchange of the check valves is simplified when the check valve is arranged in a block insertable in a feed channel and which is releasably connected with the spray boom.

In order to prevent an erroneous operation of the check valve, it is advantageously formed of a corrosion-resistant material.

Further advantages and particularities of the invention will become apparent from the following description of an embodiment of the invention.

Figure 2:
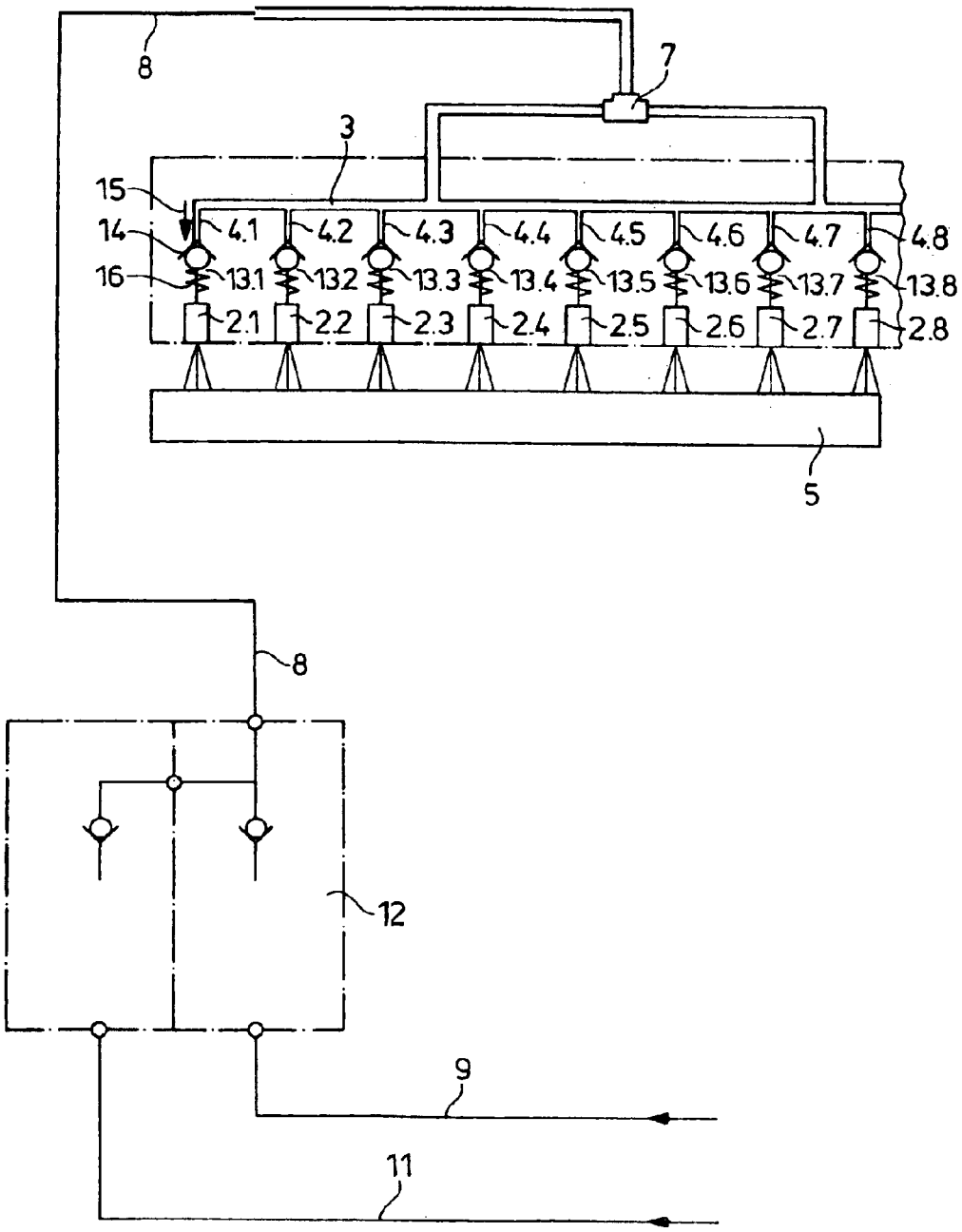

The drawings show:

FIG. 1 a cross-sectional view of a spray boom according to the present invention; and FIG. 2 a schematic side view of a spray boom according to the present invention;

FIG. 1 shows a cross-sectional view of a spray boom 1 according to the present invention with a plurality of spray nozzles 2 arranges in a row. The spray boom 1 includes a distributable pipe 3 from which a plurality of feed channels 4.1 to 4.8 branch to the spray nozzles 2.1 to 2.8. The spray nozzles 2.1 to 2.8 are arranged in a row (see FIG. 2).

With the distribution pipe 3, water 4 is fed to the spray nozzles 2.1 to 2.8 and is sprayed there on the descalable rolling stock 5 that is displaced in a direction shown in FIG. 1 with arrow 6.

A feed conduit 8 is connected to the connection 7 of the distribution pipe 3 and connects the distribution pipe with a supply 9, 11 for high pressure water and low-pressure water. An electrohydraulic control 12 controls feeding into the feed conduit 8, alternatively, of the high-pressure water with a pressure of about 200 bar and the low-pressure water with a pressure up to 10 bar.

Immediately before each spray nozzle 2.1 to 2.8, a check valve 13.1 to 13.8 is arranged. Each of the check valves 13.1 to 13.8 has a closing spring 16 that acts on a shut-off element 14 in a direction opposite the flow direction 15, and acts so that the shut-off element 14 immediately closes the feed channel 4.1 to 4.8 as soon as the electrohydraulic control 12 stops delivery of water from the supply 9, 11.

The residual water, which remains in the feed conduit 8 or in the feed channels 4.1 to 4.8, is held with the check valve 13.1 to 13.8. Because closing springs 16 having different strength are required dependent on whether the descaling facility is operated with the low-pressure or high-pressure water, the check valves 13 are arranged in blocks 17 which are screwed in the spray boom 1. The blocks 17 have inlets and outlets corresponding to the feed channels 4.1 to 4.8, so that the water flows through the check valves which are integrated in the blocks.

The control for a spray boom arranged above the strip 5 can be implemented in the same way for a control arranged beneath the strip.

LIST OF REFERENCE NUMERALS

No. Designation

1. Spray boom

2.1–2.8 Spray nozzles

3. Distribution pipe

4.1–4.8 Feed channels

5. Rolling stock

6. Displacement direction

7. Connection

8. Feed conduit
9. High-pressure water supply
10. —
11. Low-pressure water supply
12. Electrohydraulic control
13.1–13.8 Check valves
14. Shut-off element
15. Flow direction
16. Closing spring
17. Block

What is claimed is:

1. A spray boom for a hydraulic descaling facility comprising a plurality of spray nozzles for directing pressurized water jets onto a descalable stock for descaling same; a corresponding plurality of feed channels for feeding pressurized water to respective spray nozzles; and a corresponding plurality of check valves arranged in respective feed channels upstream of the spray nozzles for preventing exit of a residual water from the spray nozzles, Wherein each check valve is arranged in a block insertable in the respective feed channel and which is releasably connected with the spray boom.

2. A spray boom according to claim 1, wherein a check valve is arranged immediately upstream of a respective nozzle.

3. A spray boom according to claim 1, wherein the spray nozzles are actuated separately.

4. A spray boom according to claim 1, wherein a check valve opens against a restoring force means.

5. A spray boom according to claim 4, wherein the restoring force means comprises at least one of a spring and a weight load.

6. A spray boom according to claim 5, wherein the restoring force means comprises a closing spring acting on a shut-off element of the check valve in a direction opposite a flow direction.

7. A spray boom according to claim 1, wherein at least the check valves are formed of a corrosion-resistant material.

8. A spray boom according to claim 1, wherein the pressurized water is fed under pressure of one of high pressure of about 200 bar and low pressure of up to 10 bar.

* * * * *